US010344419B2

(12) United States Patent
Leibman

(10) Patent No.: US 10,344,419 B2
(45) Date of Patent: Jul. 9, 2019

(54) WASHING MACHINE APPLIANCE AND ADDITIVE DISPENSING ASSEMBLY

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 82 days.

(21) Appl. No.: 15/345,591

(22) Filed: Nov. 8, 2016

(65) Prior Publication Data

US 2018/0127912 A1 May 10, 2018

(51) Int. Cl.

| | |
|---|---|
| ***D06F 39/02*** | (2006.01) |
| ***D06F 37/12*** | (2006.01) |
| ***D06F 39/08*** | (2006.01) |

(52) U.S. Cl.

CPC ..... *D06F 39/02* (2013.01); *D06F 37/12* (2013.01); *D06F 39/083* (2013.01); *D06F 39/085* (2013.01); *D06F 39/088* (2013.01)

(58) Field of Classification Search

CPC ..... D06F 37/12

See application file for complete search history.

(56) References Cited

U.S. PATENT DOCUMENTS 2,677,389 A 5/1954 Jisha et al.
9,217,219 B2 12/2015 Hanau et al.

FOREIGN PATENT DOCUMENTS

EP 2902540 A1 8/2015

*Primary Examiner* — Jason Y Ko

(74) *Attorney, Agent, or Firm* — Dority & Manning, P.A.

(57) ABSTRACT

A washing machine appliance and additive dispensing assembly are provided herein. The washing machine appliance may include a cabinet, a wash tub, a wash basket, and an additive dispensing assembly. The additive dispensing assembly may be positioned within the cabinet and configured to provide wash fluid to the wash tub. The additive dispensing assembly may include a water supply conduit, a booster pump, an additive dispenser, and a siphon channel. The water supply conduit may extend between a water supply and the wash tub. The booster pump may be positioned along the water supply conduit downstream from the water supply. The siphon channel may extend from the additive dispenser to the water supply conduit downstream from the booster pump.

13 Claims, 5 Drawing Sheets

WASHING MACHINE APPLIANCE AND ADDITIVE DISPENSING ASSEMBLY

FIELD OF THE INVENTION

The present subject matter relates generally to washing machine appliances, and more particularly to additive dispensers for washing machine appliances.

BACKGROUND OF THE INVENTION

Washing machine appliances generally include a tub for containing water or wash fluid (e.g., water and detergent, bleach, and/or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. One or more fluid additives may be added to the wash fluid to enhance the cleaning or other properties of the wash fluid. The fluid additives may be in powder or concentrated liquid form, and may be added to a dispenser box of the washing machine appliance by, e.g., a user of the washing machine appliance. The dispenser box may contain various chambers for containing different additives, e.g., wash detergent and softener.

However, in order to ensure proper additive (e.g., detergent) concentrations, users must carefully measure the proper additive amount for each cycle, considering factors such as the size and type of the load, the temperature of the water, and the selected wash cycle. Although some washing machine appliances include additive dispensers that utilize aspirators for dosing, such systems may be unable to work under certain conditions. For instance, if such systems are used within a geographic region having poor water pressure (e.g., below five pounds per square inch of water pressure) the systems may be unable to force additive from the dispenser.

Accordingly, a washing machine appliance having and additive dispensing assembly that improves delivery of additives, such as detergent, is desirable. More particularly, an additive dispensing assembly that provides a suitable additive volume load across a range of water pressures would be especially desirable.

BRIEF DESCRIPTION OF THE INVENTION

Aspects and advantages of the invention will be set forth in part in the following description, or may be obvious from the description, or may be learned through practice of the invention.

In one aspect of the present disclosure a washing machine appliance is provided. The washing machine appliance may include a cabinet, a wash tub positioned within the cabinet, a wash basket, and an additive dispensing assembly. The wash basket may be rotatably mounted within the wash tub and define a wash chamber for receiving articles for washing. The additive dispensing assembly may be positioned within the cabinet and configured to provide wash fluid to the wash tub. The additive dispensing assembly may include a water supply conduit, a booster pump, an additive dispenser, and a siphon channel. The water supply conduit may extend between a water supply and the wash tub. The booster pump may be positioned along the water supply conduit downstream from the water supply. The additive dispenser may store and dispense a wash additive. The siphon channel may extend from the additive dispenser to the water supply conduit downstream from the booster pump. Moreover, a flow of water directed through the water supply conduit may create a siphon that draws the wash additive into the water supply conduit to mix with the flow of water and create a wash fluid that is dispensed into the wash tub.

In another aspect of the present disclosure, an additive dispensing assembly for providing wash fluid to a wash tub of a washing machine appliance is provided. The additive dispensing assembly may include a water supply conduit, a solenoid valve, a booster pump, an additive reservoir, and an additive supply conduit. The water supply conduit may extend between a water supply and the wash tub. The solenoid valve may be positioned along to the water supply conduit and configured to selectively provide a flow of water to the wash tub. The booster pump may be positioned along the water supply conduit downstream from the water supply. The additive reservoir may be configured for receiving a wash additive. The additive supply conduit may operably couple the additive reservoir to the water supply conduit downstream from the booster pump such that the flow of water through the water supply conduit creates a negative pressure in the additive supply conduit that draws the wash additive into the water supply conduit to mix with the flow of water and create a wash fluid that is dispensed into the wash tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
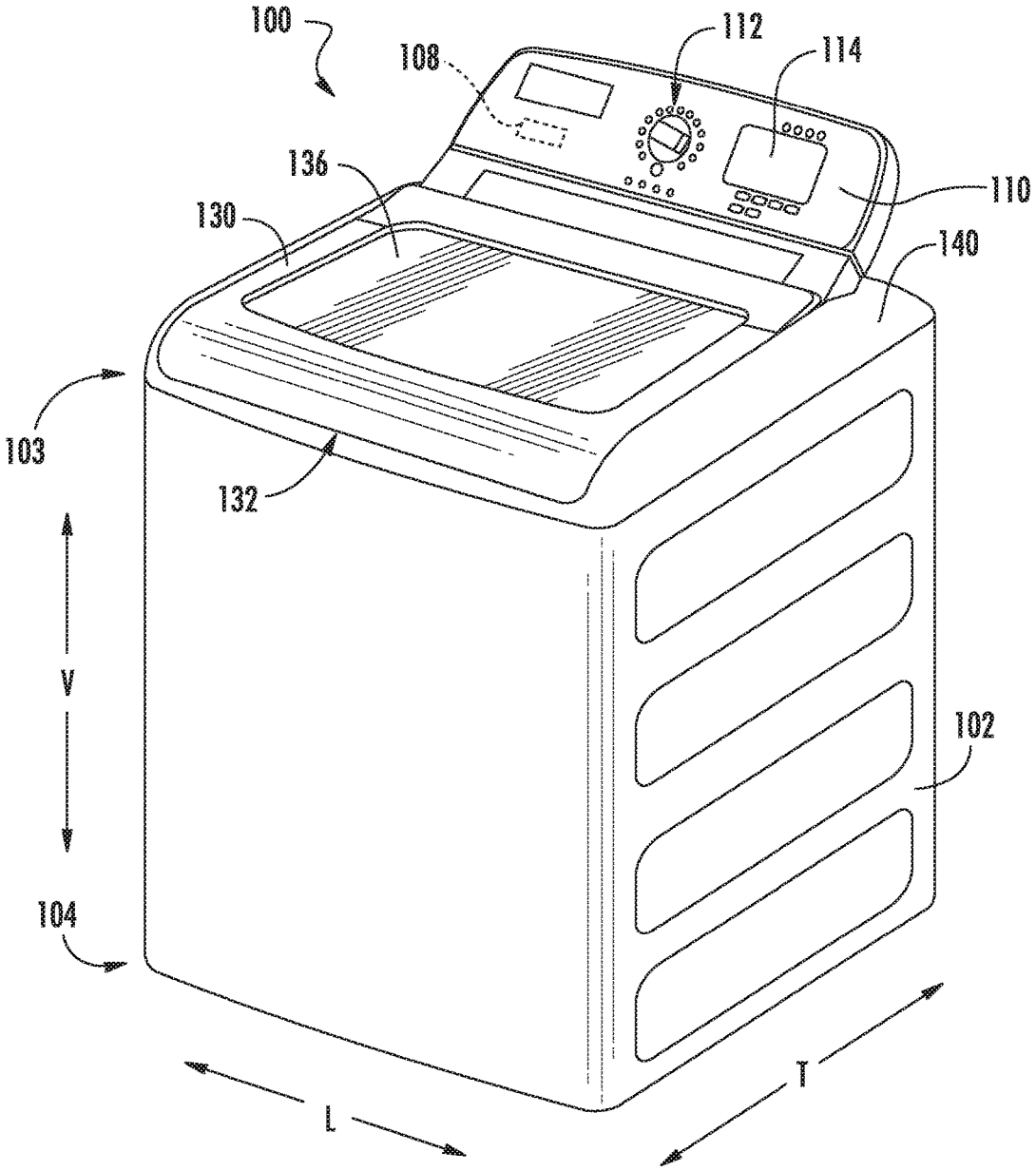
FIG. 1 provides a perspective view of a washing machine appliance according to example embodiments of the present subject matter, wherein a door of an example washing machine appliance is in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
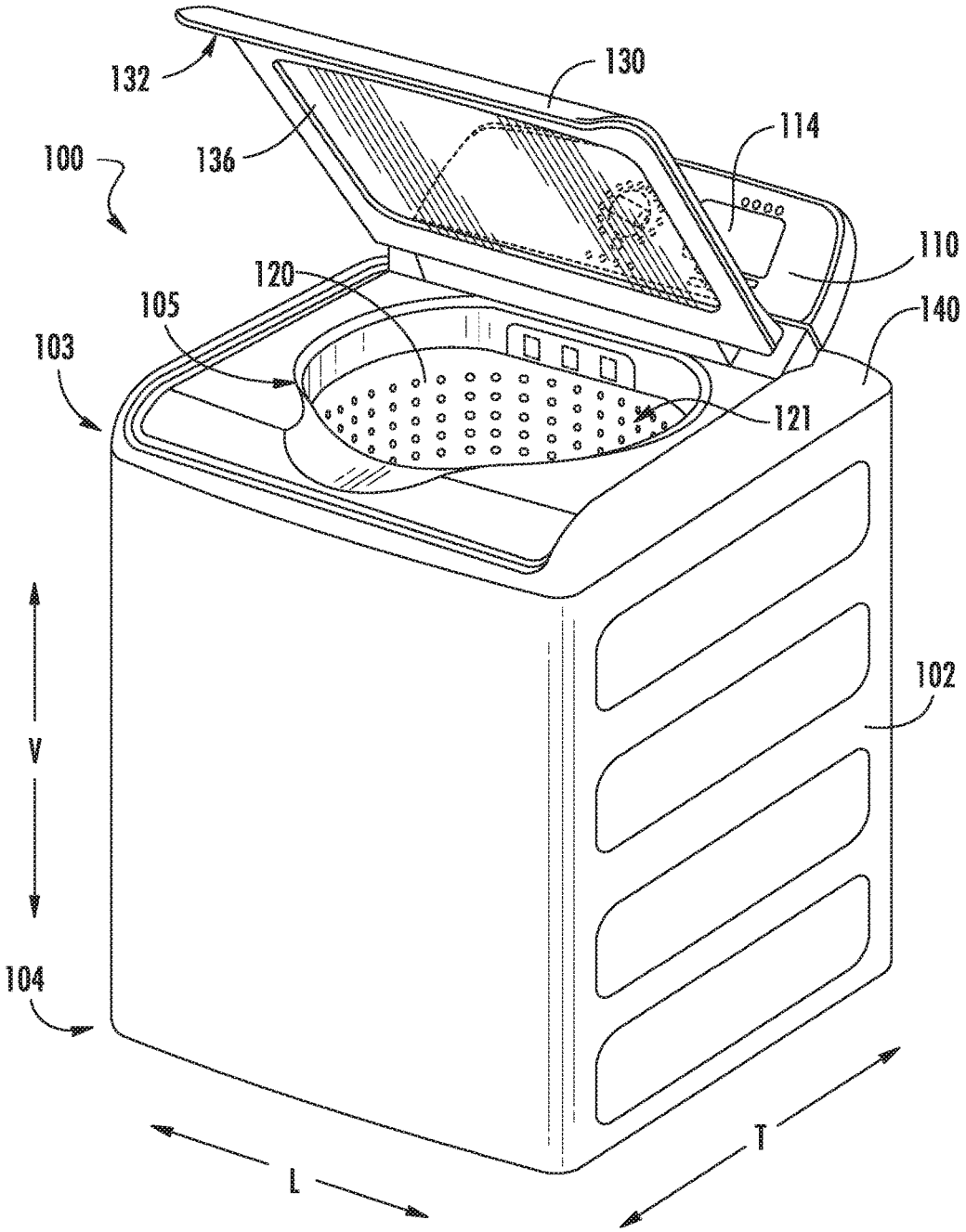
FIG. 2 provides a perspective view of the example washing machine appliances of FIG. 1, wherein the door of the example washing machine appliance is in an open position.

FIGS. 1 and 2 illustrate an example embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, which is rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. An optional window 136 in door 130 may permit viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items may be loaded into wash basket 120 through opening 105, and washing operation may be initiated through operator manipulation of input selectors 112. Wash additives may be added to washing machine appliance 100 to assist in the cleaning process. In this regard, as will be described in detail below, an additive dispensing assembly 200 is configured to provide one or more wash additives, such as powdered detergent, concentrated wash fluid, pre-treating additive, bleach, etc.

Water may be added to additive dispensing assembly 200 to mix with wash additives and create a wash fluid that may be dispensed into wash basket 120. One or more valves can be controlled by washing machine appliance 100, e.g., at controller 108, to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
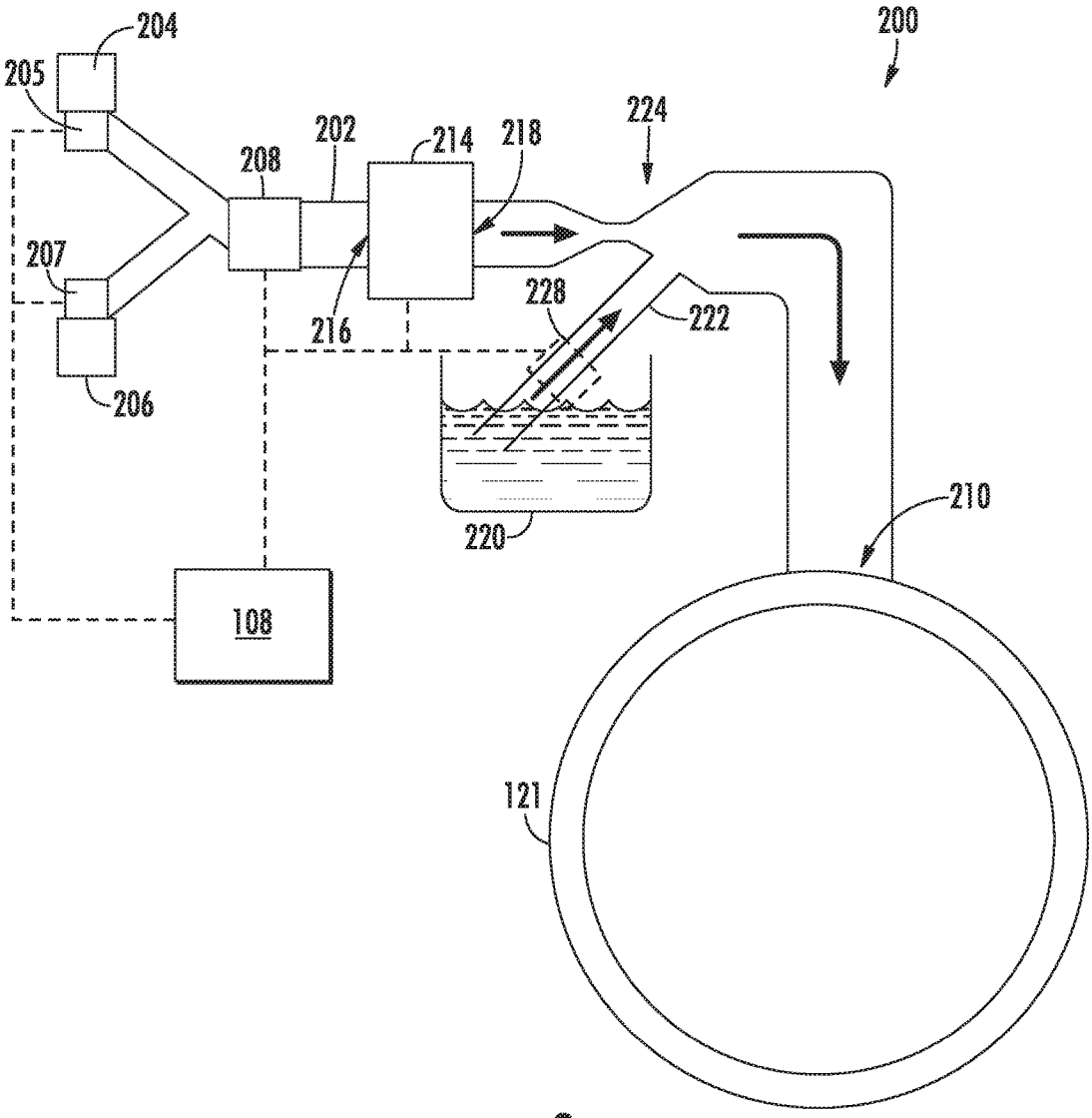
FIG. 3 provides a schematic view of an additive dispensing assembly according to example embodiments of the present subject matter.
Figure 4:
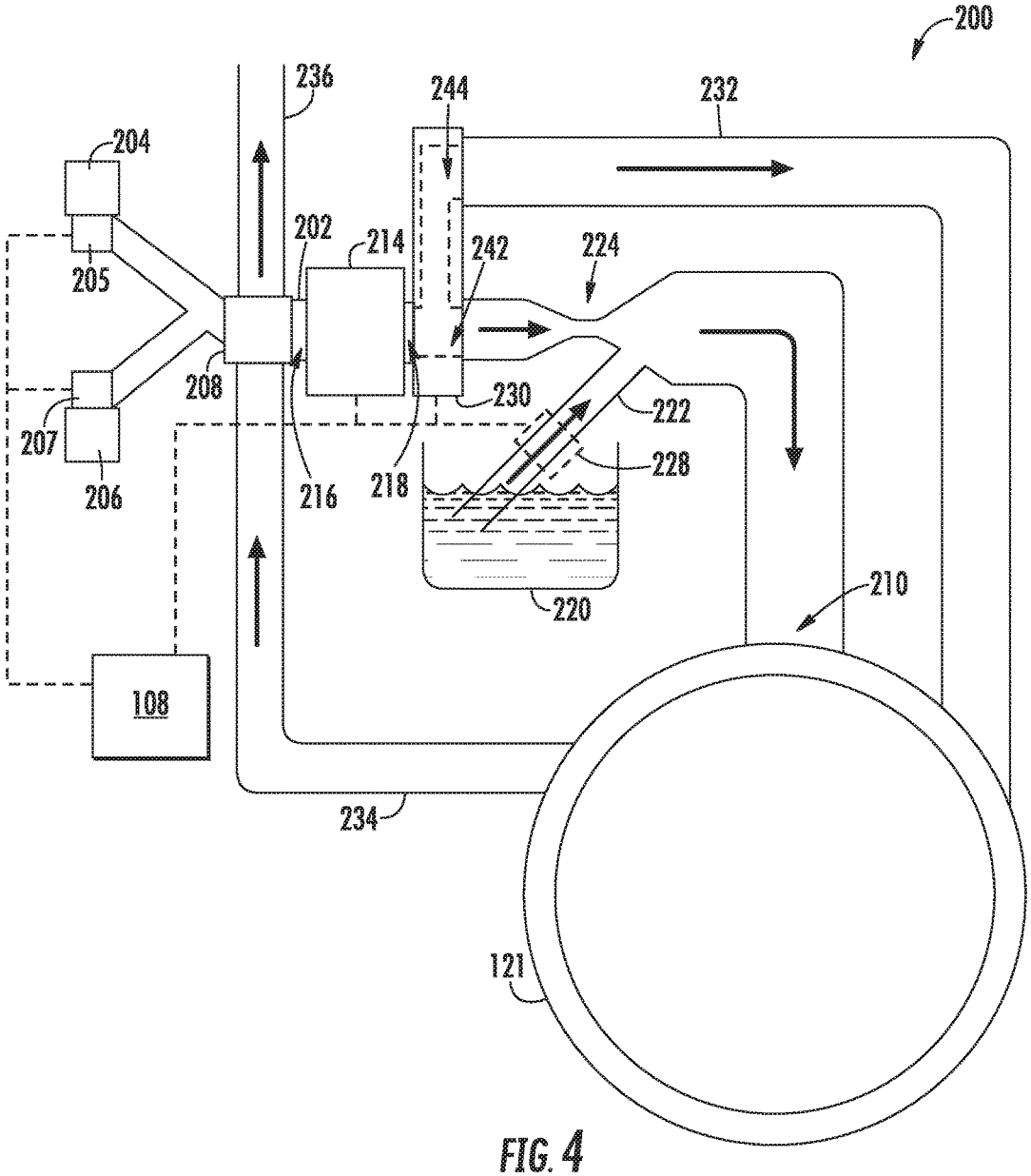
FIG. 4 provides a schematic view of another additive dispensing assembly according to example embodiments of the present subject matter.

Referring now to FIGS. 3 and 4, an additive dispensing assembly 200 for an appliance, such as washing machine appliance 100, will be described in more detail. Although the discussion below refers to additive dispensing assembly 200, one skilled in the art will appreciate that the features and configurations described may be used for other additive dispensers in other washing machine appliances as well. For example, additive dispensing assembly 200 may be positioned elsewhere within cabinet 102, may have a different components or configurations, and may dispense water, detergent, or other additives. Other variations and modifications of the example embodiments described below are possible, and such variations are contemplated as within the scope of the present subject matter.

According to an example embodiment, additive dispensing assembly 200 may be mounted within cabinet 102 using a plurality of mounting features or mechanical fasteners. Additionally or alternatively, adhesive(s), snap-fit mechanisms, interference-fit mechanisms, or any suitable combination thereof may secure additive dispensing assembly 200 to cabinet 102. One skilled in the art will appreciate that additive dispensing assembly 200 may be mounted in other locations and use other mounting means according to alternative embodiments.

Referring now specifically to FIG. 3, an example embodiment of additive dispensing assembly 200 will be described in detail. As shown, water or wash fluid is provided to wash tub 121 through a water supply conduit 202. As an example, water supply conduit 202 may receive hot and cold water from a hot water inlet 204 and a cold water inlet 206, respectively. Hot water inlet 204 may be provided on or at a hot water supply, such as a domestic or commercial hot water tank. Cold water inlet 206 may be provided on or at a cold water supply, such as a well or municipal water-supply network.

In order to dispense wash fluid at the desired temperature, hot and cold water may be selectively dispensed in ratios that produce the desired water temperature. For example, the flow of hot water through hot water inlet 204 may be selectively adjusted using a hot water solenoid valve 205. Moreover, the flow of cold water through cold water inlet 206 may be selectively adjusted using a cold water solenoid valve 207. In some embodiments, controller 108 is electrically coupled to one or more of solenoid valves 205, 206. According to one or more wash conditions, the flow of water through one or both of hot water solenoid valve 205 or cold water inlet 206 may be increased or decreased. For instance, one or both of hot water solenoid valve 205 or cold water inlet 206 may be selectively controlled to provide water at a predetermined temperature based on at least one of the selected wash cycle, the soil level of the articles to be washed, and the article type.

In additional or alternative embodiments, a diverter or supply valve 208 is fluidly connected to (e.g., in fluid communication with) hot water inlet 204 and cold water inlet 206. Supply valve 208 may be positioned downstream from inlets 204, 206 and upstream from water supply conduit 202. During operation, supply valve 208 may selectively permit water (e.g., a mixture of hot water and cold water) into water supply conduit 202. Optionally, supply valve 208 may be a solenoid valve. In some embodiments, controller 108 is electrically coupled to supply valve 208. According to one or more wash conditions, the flow of water through supply valve 208 may be increased or decreased. Optionally, supply valve 208 may be selectively controlled to limit the flow of water therethrough based on at least one of the selected wash cycle, the soil level of the articles to be washed, and the article type.

As illustrated, water supply conduit 202 may extend to (e.g., terminate at) wash tub 121. According to the illustrated embodiment, water supply conduit 202 is fluidly connected to wash tub 121 through a dispensing nozzle 210. Water supply conduit 202 may connect to wash tub 121 in any manner suitable for dispensing water and/or wash fluid into wash tub 121. For example, dispensing nozzle 210 may have a tapered or narrowed diameter from water supply conduit. Alternatively, water supply conduit 202 may simply terminate at wash tub 121 with no change in its diameter, or water supply conduit 202 may have a Venturi-shaped end.

A booster pump 214 is generally positioned along the water supply conduit 202. In certain embodiments, booster pump 214 is positioned downstream from the water supply, e.g., in fluid communication therewith. Moreover, booster pump 214 may be positioned upstream from wash tub 121. In some embodiments, booster pump 214 positioned in fluid communication between water supply valve 208 and dispensing nozzle 210. Optionally, booster pump 214 may be a positive displacement pump. Alternatively, another suitable configuration, such as a centrifugal pump may be utilized. During operations, booster pump 214 may thus operate to motivate wash fluid through water supply 202, e.g., from inlets 204, 206 to wash tub 121.

In some embodiments, controller 108 is electrically coupled to booster pump 214. According to one or more wash conditions, booster pump 214 may be activated to motivate fluid (e.g., water or wash fluid) therethrough. For instance, booster pump 214 may be selectively controlled or activated to generate a pump pressure or volumetric flow rate based on at least one of the selected wash cycle, the soil level of the articles to be washed, and the article type.

Additive dispensing assembly 200 may further include an additive dispenser 220, e.g., a reservoir for storing wash additive. In this regard, additive dispenser 220 may be configured to receive one or more wash additives. More particularly, according to an example embodiment, additive dispenser 220 is a reservoir that is intended to store sufficient wash additives for multiple wash cycles in order to avoid requiring the user to add a measured quantity of wash additive prior to each wash cycle. Wash additive may be either a liquid or particulate material (e.g., a liquid, a particulate, or a combination of a liquid and a particulate). In one embodiment, the wash additive is a detergent and in another embodiment, the wash additive is a fabric softener. In yet another embodiment, the wash additive is a mixture of detergent and fabric softener.

Additive dispenser 220 is fluidly connected to (e.g., in fluid communication with) water supply conduit 202 through an additive supply conduit 222. As illustrated, additive supply conduit 222 may define a siphon channel that draws in wash additive from additive dispenser 220 when water flows through water supply conduit 202. More particularly, as water is supplied through water supply conduit 202 into wash tub 121, the flowing water creates a negative pressure within additive supply conduit 222. This negative pressure may draw in wash additive from additive dispenser 220, e.g., in proportion to the amount of water flowing through water supply conduit 202. Additive supply conduit 222 may be calibrated according to a desired amount of wash additive. For instance, the siphon channel of additive supply conduit 222 may be sized and shaped to provide a selected flow rate, e.g., volumetric flow rate, of the wash additive. The selected flow rate of the wash additive may be set according to a predetermined flow rate and/or pressure through the water supply conduit 202, e.g., a pressure generated by booster pump 214. During operation, the selected flow rate of the wash additive may be proportional to the predetermined flow rate of wash fluid through the water supply conduit 202.

As illustrated, additive supply conduit 222 is positioned downstream from booster pump 214. Moreover, additive supply conduit 222 is positioned in fluid communication with water supply conduit 202. During operations, pressure generated at booster pump 214, e.g., between inlet 216 and outlet 218, may increase the fluid pressure (e.g., water pressure) from supply inlets 204, 206. Specifically, booster pump 214 increases pressure within water supply conduit 202 downstream from booster pump 214, e.g., at outlet 218. Booster pump 214 may thus be configured (e.g., sized and shaped) to generate a suitable water pressure within water supply conduit 202. In some embodiments, booster pump 214 is configured to generate a positive pressure between thirty pounds per square inch (30 psi) and two hundred pounds per square inch (200 psi) downstream from booster pump 214. In other embodiments, booster pump 214 is configured to generate a positive pressure greater than one hundred pounds per square inch (100 psi) downstream from booster pump 214. In certain circumstances or geographic locations, the negative pressure created within additive supply conduit 222 may thus be greater than would be created by the motivation of water from water supply inlet(s) 204, 206 alone. Advantageously, a suitable amount of additive may be supplied through additive supply conduit 222 from additive dispenser 220, even in circumstances or locations at which water supply pressure is relatively low, e.g., below five pounds per square inch (5 psi).

In optional embodiments, additive dispensing assembly 200 further includes a valve 228 configured to control the flow of wash additive through additive supply conduit 222. For example, valve 228 may be a solenoid valve that is electrically coupled to controller 108. Controller 108 may selectively open and close valve 228 to allow wash additive to flow from additive dispenser 220 through additive supply conduit 222. For example, during a rinse cycle where only water is desired, valve 228 may be closed to prevent wash additive from being drawn through additive supply conduit 222. Moreover, the flow of water through valve 228 may be increased or decreased according to one or more wash conditions. For instance, valve 228 may be selectively controlled based on at least one of the selected wash cycle, the soil level of the articles to be washed, and the article type.

As shown in FIG. 3, additive supply conduit 222 is fluidly connected to water supply conduit 202 through a Venturi nozzle 224. Venturi nozzle 224 is positioned downstream from booster pump 214 and receives the siphon channel of additive supply conduit 222. The additive supply conduit 222 and Venturi nozzle 224 may be configured (e.g., sized and shaped) to ensure the desired amount of wash additive is supplied for a given water flow rate through water supply conduit 202. For example, by adjusting the diameter of the additive supply conduit 222 and the flow restriction of Venturi nozzle 224, the volumetric flow rate of wash additive may be adjusted.

According to the illustrated example embodiments, water supply conduit 202 is fluidly connected to wash tub 121 through dispensing nozzle 210, and additive supply conduit 222 is fluidly connected to water supply conduit 202 through Venturi nozzle 224. As described above, nozzles 210, 224 may be shaped in a manner suitable for injecting wash fluid into wash tub 121 and wash additive into water supply conduit 202, respectively.

As illustrated, additive supply conduit 222 is fluidly connected to (e.g., in fluid communication with) water supply conduit 202 upstream of dispensing nozzle 210. In this manner, the flowing water may entrain, mix, and dissolve the wash additive to form a wash fluid prior to dispensing into wash tub 121 through dispensing nozzle 210. According to alternative embodiments, additive supply conduit 222 may be connected further upstream on water supply conduit 202 or in a location where wash additive may dissolve more quickly, e.g., near hot water inlet 204.

During operation, additive dispensing assembly 200 adds a wash additive from additive dispenser 220 in proportion to the amount of water flowing through water supply conduit 202. More specifically, water is provided from cold water inlet 206 and hot water inlet 204 to achieve the desired water flow rate and temperature. This flow rate and temperature may be controlled by controller 108 or may be manually adjusted by the user. Water flows into the water supply conduit 202 past Venturi nozzle 224, creating a negative pressure in additive supply conduit 222. This negative pressure draws in wash additive from additive dispenser 220. The wash additive travels through additive supply conduit 222 and is injected into water supply conduit 202 by Venturi nozzle 224. The water traveling through water supply conduit 202 entrains, mixes, and dissolves the wash additive to create a wash fluid that is dispensed into wash tub 121. Notably, the concentration of wash additive in the wash fluid may be proportional to the amount of water delivered to wash tub 121.

As illustrated in FIG. 4, further embodiments of additive dispensing assembly 200 include a recirculation valve 230. Recirculation valve 230 may be positioned along water supply conduit 202. Specifically, recirculation valve 230 may be positioned in fluid communication between booster pump 214 and additive supply conduit 222. Moreover, a recirculation line 232 extends separately from recirculation valve 230. For instance, recirculation line 232 may extend in fluid communication between recirculation valve 230 and wash tub 121. When assembled, recirculation line 232 may effectively bypass siphon channel of additive supply conduit 222.

A return line 234 may extend in fluid communication between wash tub 121 and supply conduit 202, e.g., to supply valve 208. During select operations, fluid (e.g., water or wash fluid) from wash tub 121 may thus be selectively returned to supply conduit 202. Additionally or alternatively, a drain line 236 may extend in fluid communication from supply valve 208, e.g., to an ambient environment outside of the appliance 100 (FIG. 1).

Recirculation valve 230 may generally define an additive valve channel 242 permitting fluid to flow to Venturi nozzle 224 and a bypass valve channel 244 permitting fluid to flow to recirculation line 232. A diverter (not pictured) may selectively open or close valve channels 242, 244. For instance, when one channel (e.g., additive valve channel 242) is open, the other channel (e.g., bypass valve channel 244) may be closed. When additive valve channel 242 is opened, fluid may be directed through Venturi nozzle 224 to draw additive through additive supply conduit 222. When bypass valve channel 244 is opened, fluid may be directed away from Venturi nozzle 224 and directly to wash tub 121. Moreover, fluid within wash tub 121 may be directed to supply conduit 202. Specifically, water or wash fluid may be motivated from wash tub 121 through return line 234 to supply valve 208. Booster pump 214 may motivate tub fluid into supply conduit 202 and through booster pump 214, e.g., before the tub fluid is motivated into recirculation line 232. Additionally or alternatively, booster pump 214 may motivate tub fluid out of system 200 through drain line 236. For instance, supply valve 208 may be a three-way or four-way valve configured to selectively direct fluid from recirculation line 232 to one or both of supply conduit 202 or drain line 236.

In some embodiments, controller 108 is electrically coupled to recirculation valve 230. According to one or more wash conditions, the flow of water through recirculation valve 230 may be selectively directed to one or more of additive valve channel 242 or bypass valve channel 244. For instance, recirculation valve 230 may be selectively controlled to selectively open and/or close channels 242, 244 based on at least one of the selected wash cycle, the soil level of the articles to be washed, and the article type.

Figure 5:
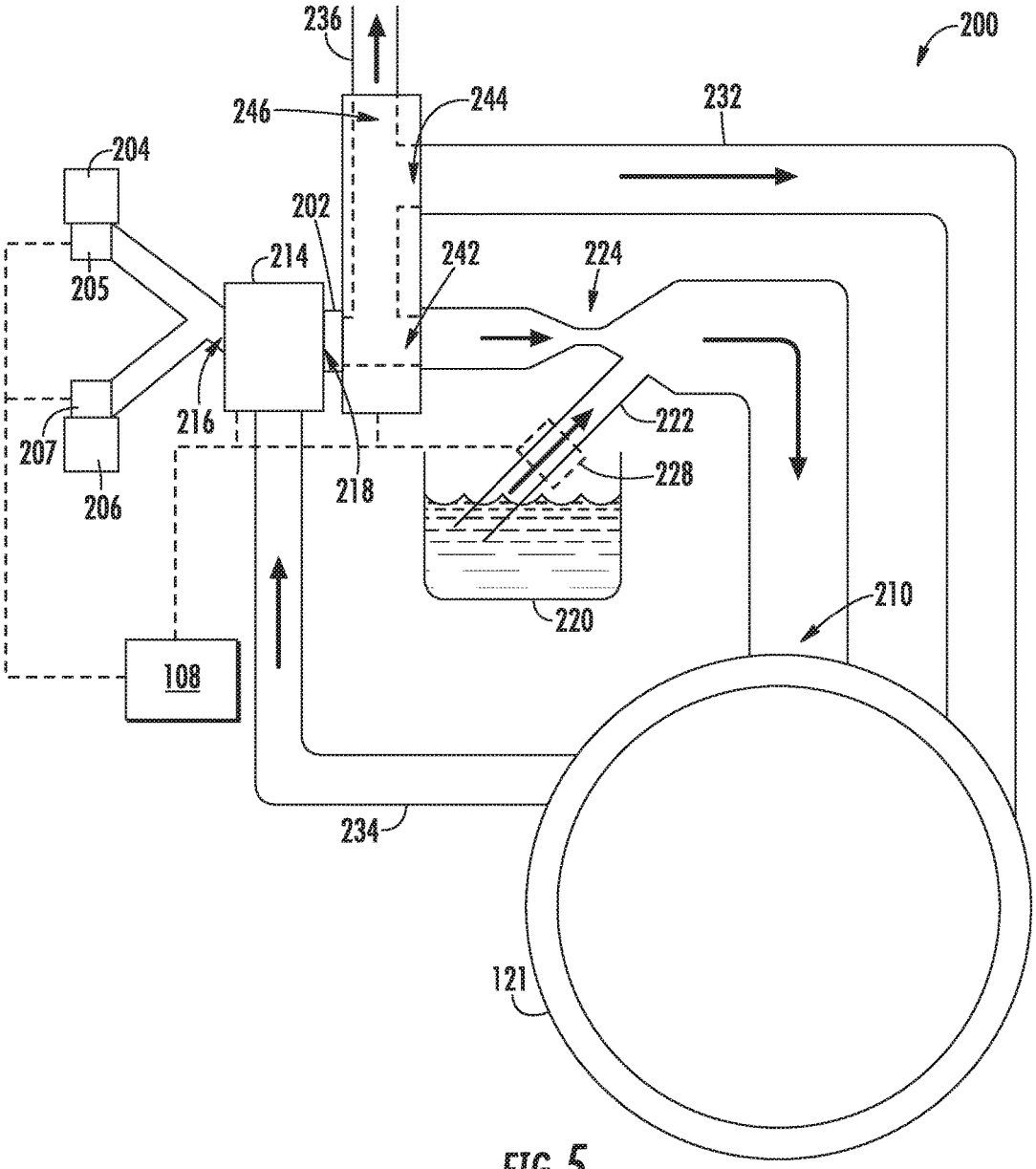
FIG. 5 provides a schematic view of yet another additive dispensing assembly according to example embodiments of the present subject matter.

As illustrated in FIG. 5, in still further embodiments of additive dispensing assembly 200, return line 234 extends in fluid communication between wash tub 121 and supply conduit 202. Specifically, return line 234 is fluidly connected directly to pump 214 (i.e., in direct fluid communication therewith). Drain line 236 extends in fluid communication from recirculation valve 230. In some such embodiments, recirculation valve 230 defines three discrete channels 242, 244, 246. Additive valve channel 242 may permit fluid to flow to Venturi nozzle 224, bypass valve channel 244 may permit fluid to flow to recirculation line 232, and a drain valve channel 246 may permit fluid to drain line 236. A diverter (not pictured) may selectively open or close valve channels 242, 244, 246. When additive valve channel 242 is opened, fluid (e.g., water) may be directed through Venturi nozzle 224 to draw additive through additive supply conduit 222. When bypass valve channel 244 is opened, fluid may be directed away from Venturi nozzle 224 and directly to wash tub 121. When drain valve channel 246 is opened, fluid may be directed away from Venturi nozzle 224 and directly to wash tub 121. For instance, when one channel (e.g., additive valve channel 242) is open, the other channels (e.g., bypass valve channel 244 and drain valve channel 246) may be closed.

During operation, fluid (e.g., water or wash fluid) within wash tub 121 may be directed to supply conduit 202 through return line 234 to booster pump 214. Booster pump 214 may motivate tub fluid into supply conduit 202 and through booster pump 214, e.g., before the tub fluid is motivated into and through recirculation line 232.

In some embodiments, controller 108 is electrically coupled to recirculation valve 230. According to one or more wash conditions, the flow of fluid through recirculation valve 230 may be selectively directed to one or more of additive valve channel 242, bypass valve channel 244, or drain valve channel 246. For instance, recirculation valve 230 may be selectively controlled to selectively open/close channels 242, 244, 246 based on at least one of the selected wash cycle, the soil level of the articles to be washed, and the article type.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub, the wash basket defining a wash chamber for receiving articles for washing;

an additive dispensing assembly positioned within the cabinet and configured to provide wash fluid to the wash tub, the additive dispensing assembly comprising a water supply conduit extending between a water supply and the wash tub, a booster pump positioned along the water supply conduit downstream from the water supply, an additive dispenser for storing and dispensing a wash additive, and a siphon channel extending from the additive dispenser to the water supply conduit downstream from the booster pump, wherein a flow of water directed through the water supply conduit creates a siphon that draws the wash additive into the water supply conduit to mix with the flow of water and create a wash fluid that is dispensed into the wash tub;

a recirculation valve disposed in fluid communication between the booster pump and the siphon channel to selectively permit the flow of water across the siphon channel; and a recirculation line extending in fluid communication between the recirculation valve and the wash tub to bypass the siphon channel.

2. The washing machine appliance of claim 1, wherein the water supply conduit includes a Venturi nozzle downstream from the booster pump to receive the siphon channel.

3. The washing machine appliance of claim 1, wherein the water supply conduit is in fluid communication with both a hot water supply through a hot water inlet and a cold water supply through a cold water inlet.

4. The washing machine appliance of claim 1, wherein the siphon channel is calibrated to provide a selected flow rate of the wash additive.

5. The washing machine appliance of claim 4, wherein the selected flow rate of the wash additive is proportional to a flow rate of the flow of water through the water supply conduit.

6. The washing machine appliance of claim 1, further comprising a valve positioned along the siphon channel for controlling the flow of the wash additive through the siphon channel.

7. The washing machine appliance of claim 6, wherein the valve is a solenoid valve that is selectively controlled based on at least one of the selected wash cycle, the soil level of the articles to be washed, and the article type.

8. The washing machine appliance of claim 1, wherein the wash additive includes detergent or fabric softener.

9. The washing machine appliance of claim 1, further comprising a return line extending in fluid communication from the wash tub to the supply valve.

10. The washing machine appliance of claim 9, wherein the supply valve is configured to selectively direct fluid from the return line to the water supply conduit and the recirculation line.

11. The washing machine appliance of claim 1, further comprising a drain line extending in fluid communication from the supply valve to an ambient environment outside of the washing machine appliance.

12. The washing machine appliance of claim 11, further comprising a return line extending in fluid communication from the wash tub to the supply valve.

13. The washing machine appliance of claim 12, wherein the supply valve is configured to selectively direct fluid from the return line to the recirculation line, the water supply conduit, and the drain line.

* * * * *